US010624475B2

(12) United States Patent
Holt

(10) Patent No.: US 10,624,475 B2
(45) Date of Patent: Apr. 21, 2020

(54) BEDDING SHEET SYSTEM

(71) Applicant: Susan P. Holt, Columbia, MO (US)

(72) Inventor: Susan P. Holt, Columbia, MO (US)

( * ) Notice: Subject to any disclaimer, the term of this patent is extended or adjusted under 35 U.S.C. 154(b) by 223 days.

(21) Appl. No.: 15/898,469

(22) Filed: Feb. 17, 2018

(65) Prior Publication Data

US 2019/0099018 A1 Apr. 4, 2019

Related U.S. Application Data

(60) Provisional application No. 62/565,111, filed on Sep. 29, 2017.

(51) Int. Cl.

| | |
|---|---|
| ***A47C 31/00*** | (2006.01) |
| ***A47G 9/02*** | (2006.01) |
| ***A47C 21/02*** | (2006.01) |
| ***A47G 9/04*** | (2006.01) |
| ***A47C 27/00*** | (2006.01) |

(52) U.S. Cl.

CPC ..... *A47G 9/0238* (2013.01); *A47C 21/022* (2013.01); *A47C 27/001* (2013.01); *A47G 9/02* (2013.01); *A47G 9/04* (2013.01)

(58) Field of Classification Search

CPC ..... A47C 31/007; A47C 31/00
USPC ..... 5/496–497
See application file for complete search history.

(56) References Cited

U.S. PATENT DOCUMENTS

| | | | | |
|---|---|---|---|---|
| 6,098,219 | A | 8/2000 | Milber | |
| 7,007,325 | B1 * | 3/2006 | Gomeh | A47C 21/022 5/496 |
| 7,487,561 | B2 | 2/2009 | Ho | |
| 8,122,541 | B1 | 2/2012 | Georgatos | |
| 9,549,625 | B1 | 1/2017 | Wilkinson et al. | |
| 2009/0049608 | A1 * | 2/2009 | Bell | A47C 31/007 5/499 |
| 2014/0115781 | A1 | 5/2014 | John | |

* cited by examiner

*Primary Examiner* — Frederick C Conley
(74) *Attorney, Agent, or Firm* — Don V. Kelly; Evans & Dixon, L.L.C.

(57) ABSTRACT

A bedding system for a mattress includes a mattress cover. The mattress cover has an exterior surface, an interior compartment and an opening sized and shaped to allow insertion of the mattress into the cover. The opening is preferably reclosable. The cover is sized and shaped to receive the mattress inside it such that when the covering material snugly envelopes the mattress, it follows the contours of the sides and panels of the mattress. The mattress cover includes a plurality of cover fasteners disposed along a first side portion, a second side portion, a head portion and a foot portion. The system includes a first sheet with a plurality of sheet fasteners that engage the plurality of cover fasteners. When the sheet is overlaid onto the mattress cover and each of the sheet fasteners engages one of the plurality of cover fasteners, the edges and panels of the sheet aligns with the panels of the mattress. A second sheet includes fasteners at least along one edge that allows the second sheet to attach to the first sheet.

2 Claims, 10 Drawing Sheets

BEDDING SHEET SYSTEM

CROSS REFERENCE TO RELATED APPLICATION

This application claims the benefit of and incorporates by reference the entirety of US Provisional Patent Application No. 62/565,111 filed on Sep. 29,2017.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to bed clothes and more specifically relates to a system for installing sheets onto beds.

BACKGROUND OF THE INVENTION

In the hospitality industry, room cleaning staff are tasked with cleaning and tidying rooms to make them inviting to guests. Among the most important tasks in cleaning a hotel and motel room is that of making the beds so that guests are presented with a dean, well-organized and inviting temporary habitation. The conventional bed linen set includes a fitted bottom sheet, a rectangular top sheet and one or more pillow cases. Neat and proper placement of the fitted sheet and top sheet is necessary, particularly in the hospitality industry, to ensure that the bed is neatly made and visually inviting to guests. Because of the ubiquitous fitted sheet of the conventional bed linen set, changing a bed is a time consuming process. The process is also one that requires lifting of heavy and ungainly mattresses in order to install the fitted sheet neatly around the mattress. When installed neatly on the mattress, the fitted sheet snugly envelopes the mattress such that the portion of the sheet atop the mattress is smooth, free from wrinkles and not bunched in sections. At the same time, the elastic corner pockets of the fitted sheet must securely receive the corners of the mattress in such a way that the fitted sheet does not come loose during sleeping. Accordingly, to properly install a conventional fitted sheet on a conventional mattress, the mattress must be lifted at least four times during the installation process to make certain that the corner pockets are tucked under the mattress sufficiently to hold the corners. Likely, when making the bed, repositioning of the fitted sheet's corner pockets vis-à-vis the mattress corners will be required, meaning the mattress will need to be lifted more than the minimum four times.

Additionally, with the prior art bed linen set, once the bottom sheet is fitted to the mattress, the top sheet must be laid on top of the bottom fitted sheet and positioned both lengthwise and widthwise to neatly make the bed. As the top sheet in its installed configuration atop the fitted sheet must also be smooth, free from wrinkles and not bunched in sections, the person tasked with making the bed will need to lift the mattress again in order to properly tuck the top sheet under the mattress. In addition, for benefit of both aesthetics and sleeper comfort, the top sheet must be properly positioned on both the fitted sheet and mattress so that it covers the periphery of the mattress in a balanced way and does not overhang the mattress in disparate and awkward ways. This aligning process may require several trips around the bed in order to properly position the sheets relative to each other and the mattress. In the case of large beds, the process may require more than one person in order to properly position the sheets. The foregoing process is thus, both time-consuming and laborious. The larger the bed, the more laborious the sheet installation process.

Conventional bedding systems have deficits in addition to those referable to the installation process. In this respect, the conventional fitted sheet includes corner hems containing lengths of elastic strips that cause the corners of the sheet to bunch and wrinkle. This bunching and wrinkling make the fitted sheets difficult to easily and neatly fold, in addition, the bunched and wrinkled sections result in the sheet, once folded, having an irregular shape that easily unfolds when touched or handled. Accordingly, it would be an advantage in the art to provide an improved bedding system. A suitable solution is desired.

Various attempts have been made to solve problems found in the bed linen art. Among these are found in: U.S. Pat. No. 8,122,541 to Georgatos; U.S. Pat. No. 9,549,625 to Wilkinson, et al.; U.S. Pat. No. 6,098,219 to Milber; U.S. Pat. No. 7,487,561 to Ho; and U.S. Published Patent Application No. 2014/0115781 to John. This prior art is representative of bed linens. None of the solutions disclosed in the foregoing references either singly or in combination, satisfactorily solves the deficits of the prior art bedding system There is, thus, a need for an easy to use bedding sheet system that overcomes the drawbacks of the prior art bedding systems.

SUMMARY OF THE INVENTION

The present invention is directed to a bedding system for securing bed linens to a mattress. As is well understood from the prior art, the mattress has a top panel, a bottom panel, a head panel, a foot panel, a first mattress side panel extending from the head panel to the foot panel and a second side mattress panel extending from the head panel to the foot panel. The bedding system comprises a mattress cover. The mattress cover has a covering material with an exterior surface, an interior compartment and an opening allowing access to the interior compartment. The opening of the mattress cover is sized and shaped to allow insertion of the mattress into the interior compartment of the mattress cover. The mattress cover is also sized and shaped to receive the mattress inside it such that When the mattress is inside the mattress cover, the covering material snugly envelopes the mattress. In a preferred embodiment the opening is a reclosable (sealable) opening. Exemplary reclosing mechanisms include a zipper, hook and loop fasteners, buttons and button holes and snap buttons.

When the mattress is enveloped by the mattress cover: a first side portion of the mattress cover is adjacent to and follows the contour of the first mattress side panel; a second side portion of the mattress cover is adjacent to and follows the contour of the second mattress side panel; a head portion of the mattress cover is adjacent to the head panel of the mattress; and a foot portion of the mattress cover is adjacent to the foot panel of the mattress. The mattress cover includes a plurality of cover fasteners disposed on the first side portion of the mattress cover, the second side portion of the mattress cover, the head portion of the mattress cover and the foot portion of the mattress cover.

The system also includes a first sheet, which as will be clear from the following description replaces the fitted sheet of the prior art. The first sheet includes a first plurality of sheet fasteners. Each of the first plurality of sheet fasteners complementarily engages one of a plurality of cover fasteners disposed on the first side portion of the mattress cover, the second side portion of the mattress cover, the head portion of the mattress cover and the foot portion of the mattress cover.

In a preferred embodiment of the invention, the first sheet includes a head edge, a foot edge, a first side sheet panel and a second side sheet panel. When the mattress is inserted into the mattress cover and the first sheet is overlaid onto the mattress cover and each of the first plurality of sheet fasteners complementarily engages one of the plurality of cover fasteners, the head edge of the first sheet is adjacent to the head portion of the mattress cover and aligns with the head panel of the mattress, the foot edge of the first sheet is adjacent to the foot portion of the mattress cover and aligns with the foot panel of the mattress, the first side sheet panel overlays the first side portion of the mattress cover and aligns with the first mattress side panel and the second side sheet panel overlays the second side portion of the mattress cover and aligns with the second mattress side panel.

In a first preferred embodiment, the cover fasteners and first plurality of sheet fasteners comprise complementary hook and loop (Velcro®) fasteners. In this embodiment, it is preferable that a cover fastener comprise a swatch including the hook portion of the known hook and loop fastening system sewn into the mattress cover. The sheet fastener would preferably be a swatch containing the loop portion of the hook and loop fastening system.

In a second embodiment, the cover fasteners and the first plurality of sheet fasteners comprise engaging snaps buttons (fasteners) consisting of a male button that is received by a female button. In this embodiment, it is preferable that a cover fastener comprise the male button and the sheet fastener comprise the female button. In another embodiment, the complementary fasteners could comprise buttons on one of the cover or first sheet and buttonholes on the other. In this embodiment, it is preferable that the cover fastener be a button and the sheet fastener be the buttonhole.

The inventive system, regardless of fastener type used, can also include a second sheet releasably attachable to the first sheet. This second sheet would serve as the top sheet known in the prior art. However, in contrast to the prior art systems, the first sheet and second sheet include complementary fasteners (respectively a second plurality of sheet fasteners and a third plurality of sheet fasteners) that secure the second sheet atop the first sheet, preferably at the foot portion of the second sheet.

The present invention advantageously overcomes the aforementioned deficits of the prior art bedding arrangement by providing for a fastened sheet system. By virtue of the mattress cover, the system can be used on existing bedding arrangements simply by sizing the mattress cover and sheets to fit a particular mattress. This is a much more economical and adaptable alternative than other proposed systems requiring specialized mattresses or components in additions to sheets and the mattress cover. The mattress cover and sheets of the present invention system can be easily sized to fit existing mattresses whether they be conventionally sized or specially sized. The present invention is thus superior to other systems that would require a large investment of money and time to replace the mattresses in existing bedding arrangements. In addition, the present invention systems provides for a faster and easier process of making a bed. Also, because the first sheet does not require wrinkled and bunched-fabric corners of the prior art fitted sheet, the first sheet of the present invention system can be folded flat.

In the preferred embodiment, cover fasteners are located at the bottom of both side portions of the mattress cover so that the first sheet will tightly cover the mattress cover and align with the panels of the mattress. The cover fasteners located on the head and foot portions of the mattress cover need not be located on the lower parts of these portions. Instead, these cover fasteners can be located at the top edges of the mattress cover. This design makes installing the first sheet on the mattress more convenient and easier. In this respect, many beds have large head and foot boards that can make access between the mattress and boards difficult. By locating the cover fasteners on the head and foot portions of the mattress cover, one changing the bed need not have to squeeze his or her hands between the boards and the mattress or raise the mattress so high or at all to secure the sheet fasteners to the cover fasteners. Once the cover is securely in place on the mattress, the sheet may he placed over the top and connected by engaging each of the first plurality of sheet fasteners with a cover fastener. The system may also feature an elastic band that goes around the sheet, which is to help with possible stretching and shrinking of the sheet. This system makes it quicker and easier to replace a sheet for any reason.

DETAILED DESCRIPTION

Figure 1:
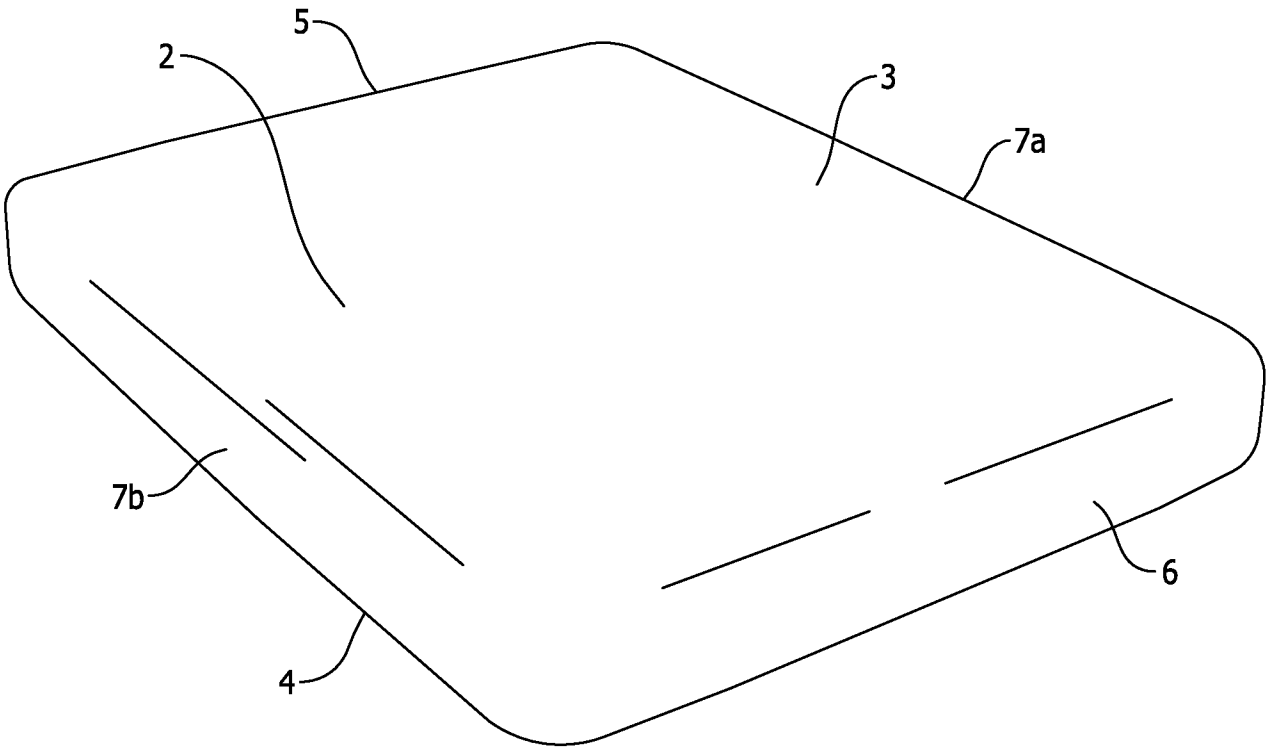
FIG. 1 is a perspective view of a mattress known in the prior art.
Figure 2:
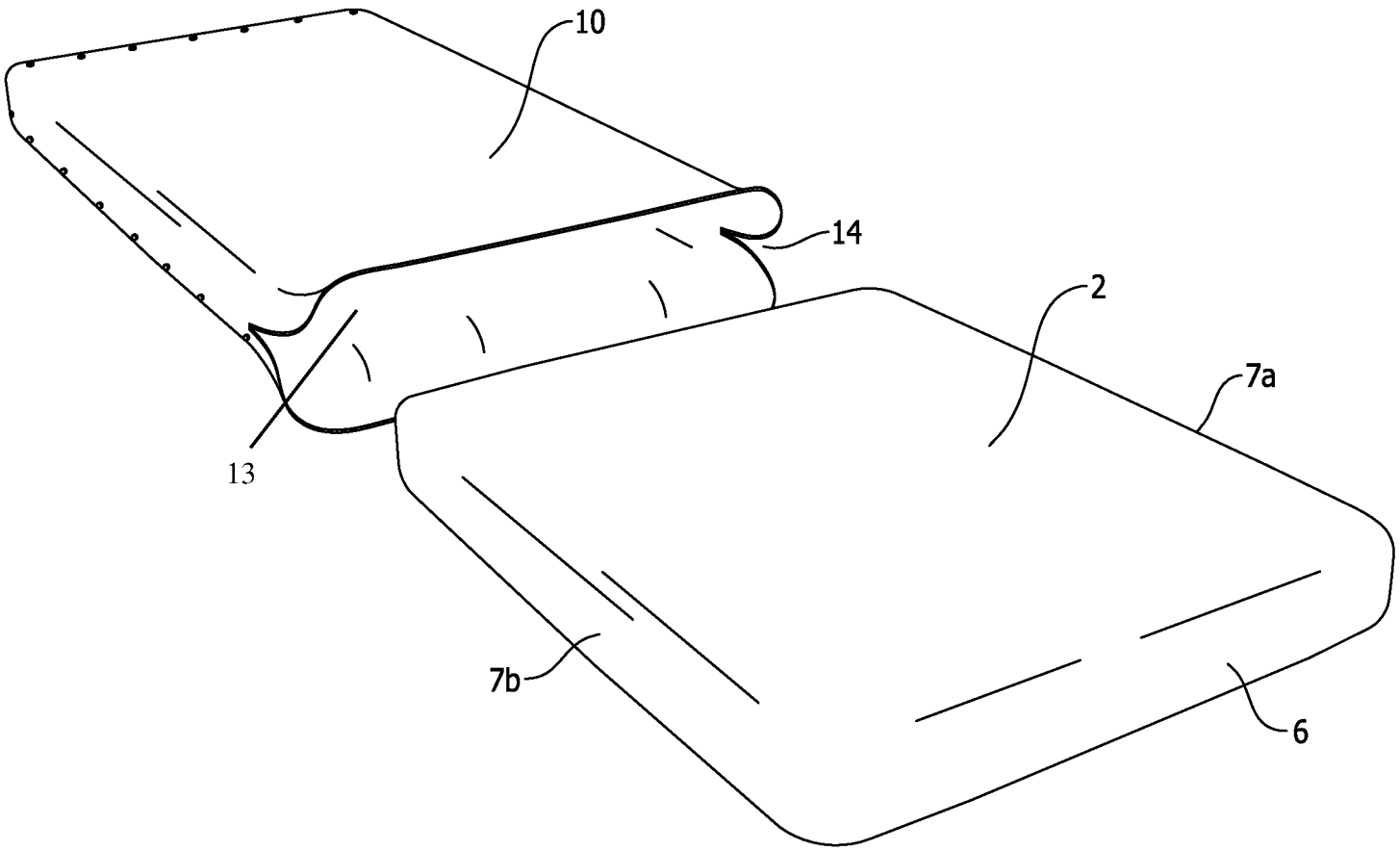
FIG. 2 is a perspective view showing, for an embodiment of the invention, how a mattress is inserted into the opening of the mattress cover of an embodiment of the present invention system.

The various embodiments of the present invention will hereinafter be described in conjunction with the figures accompanying this application. FIGS. 2-10 show embodiment versions or constituents of the present invention bedding system 1 for securing bed linens to a mattress 2. The constituent parts of a prior art mattress 2 are shown in FIG. 1. Prior art mattress 2 includes top panel 3, a bottom panel 4, a head panel 5, a foot panel 6 and first and second side panels 7*a,* 7*b,* each extending from head panel 5 to foot panel 6.

Figure 3:
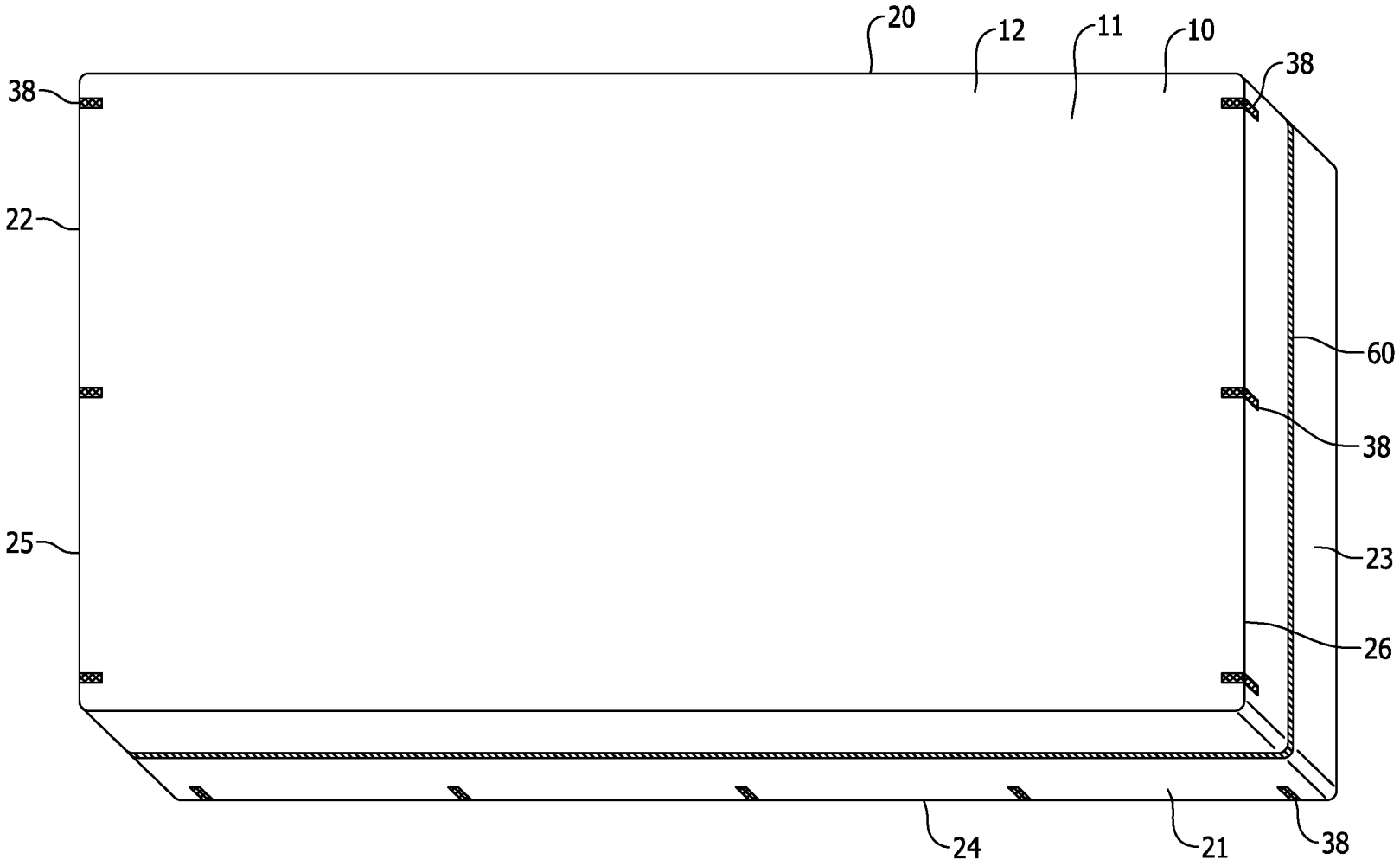
FIG. 3 is a perspective view of a mattress cover of a preferred embodiment system of the inventive sheet system utilizing complementary hook and loop fasteners to secure the first sheet to the mattress cover. The mattress cover preferably has swatches of strips that have hook fastener segments to engage swatches of strips having loop fasteners secured to the underside of the first sheet as shown in FIG. 4.
Figure 4:
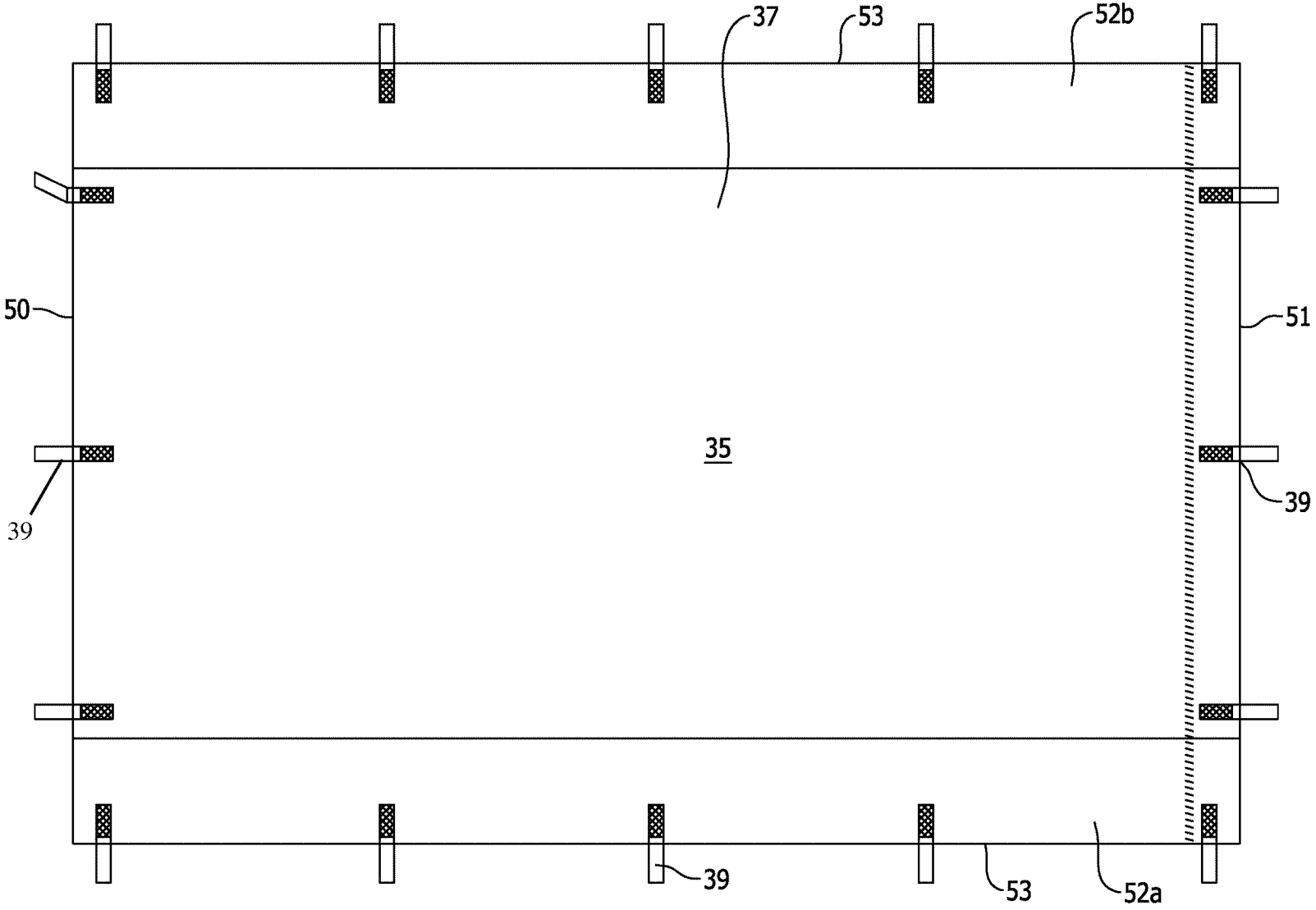
FIG. 4 is a plan view of the underside of a first sheet of an embodiment system using hook and loop fasteners to secure the first sheet to the mattress cover.
Figure 5:
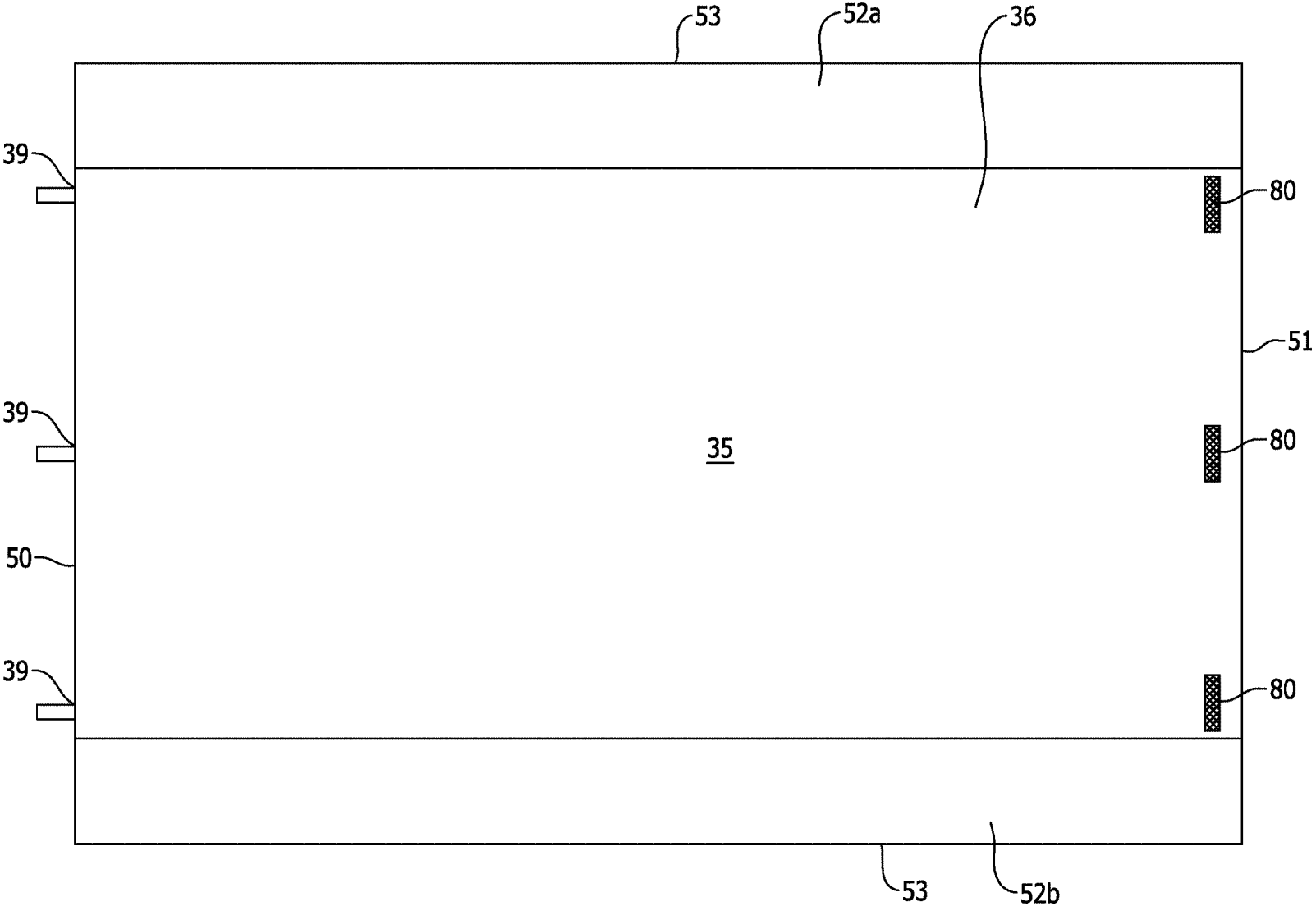
FIG. 5 is a plan view of the top of an embodiment first sheet having swatches of strips located at the foot of the first sheet that have loop fastener segments to engage swatches of strips having hook fasteners secured to the underside of the second (top) sheet shown in FIG. 6.
Figure 6:
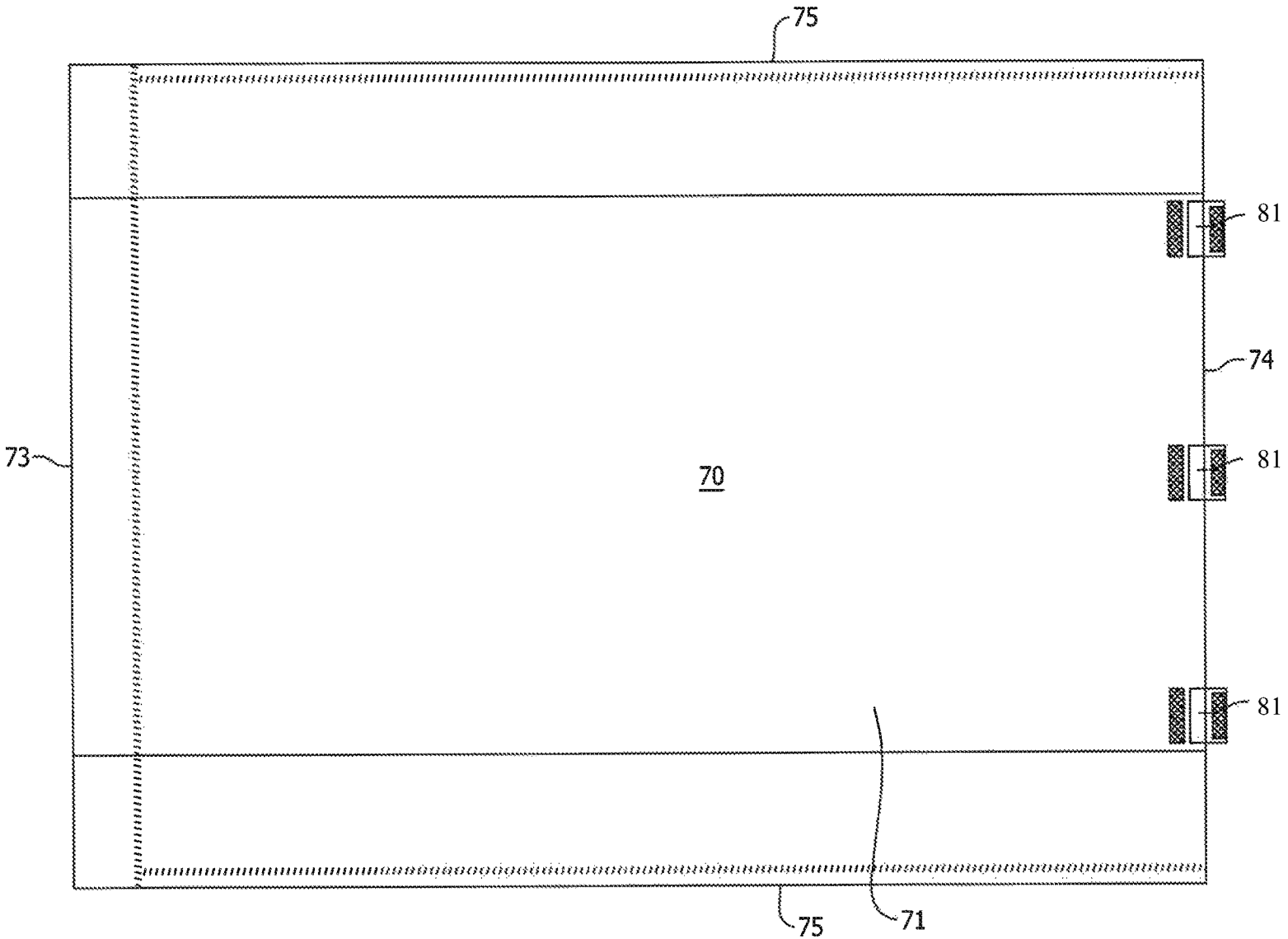
FIG. 6 is a plan view of the underside of an embodiment second sheet having swatches of strips located as the foot of the second Sheet that have hook fastener segments to engage swatches of strips having loop fasteners secured to the top of the first sheet shown in FIG. 5.
Figure 7:
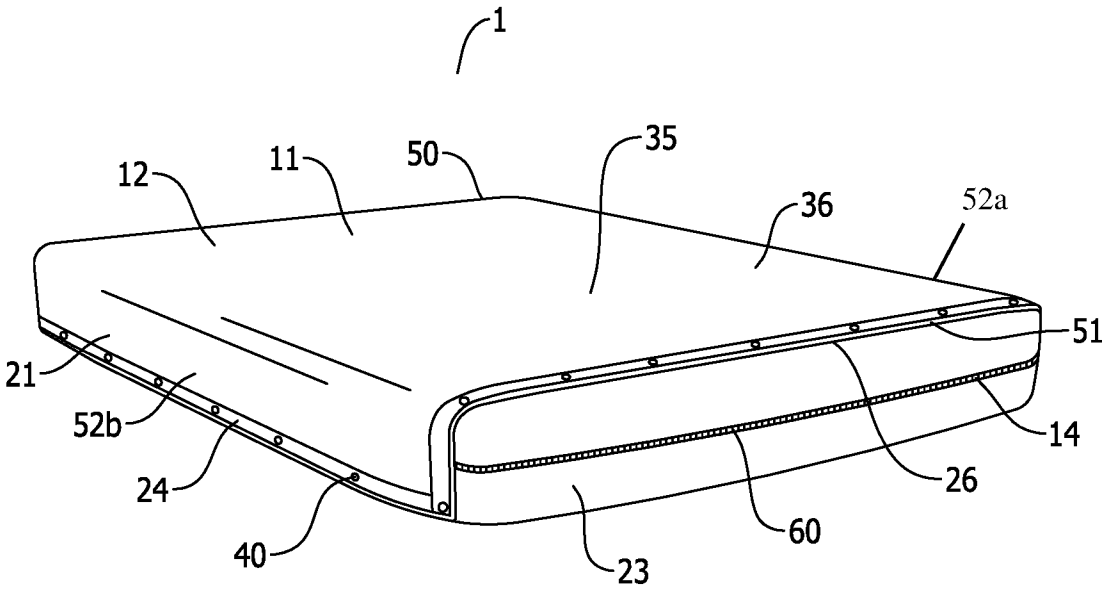
FIG. 7 depicts a preferred embodiment of the present invention bedding system showing the first sheet secured to the mattress cover via snap buttons, the mattress cover having a mattress (not shown) contained within its covering material.
Figure 8:
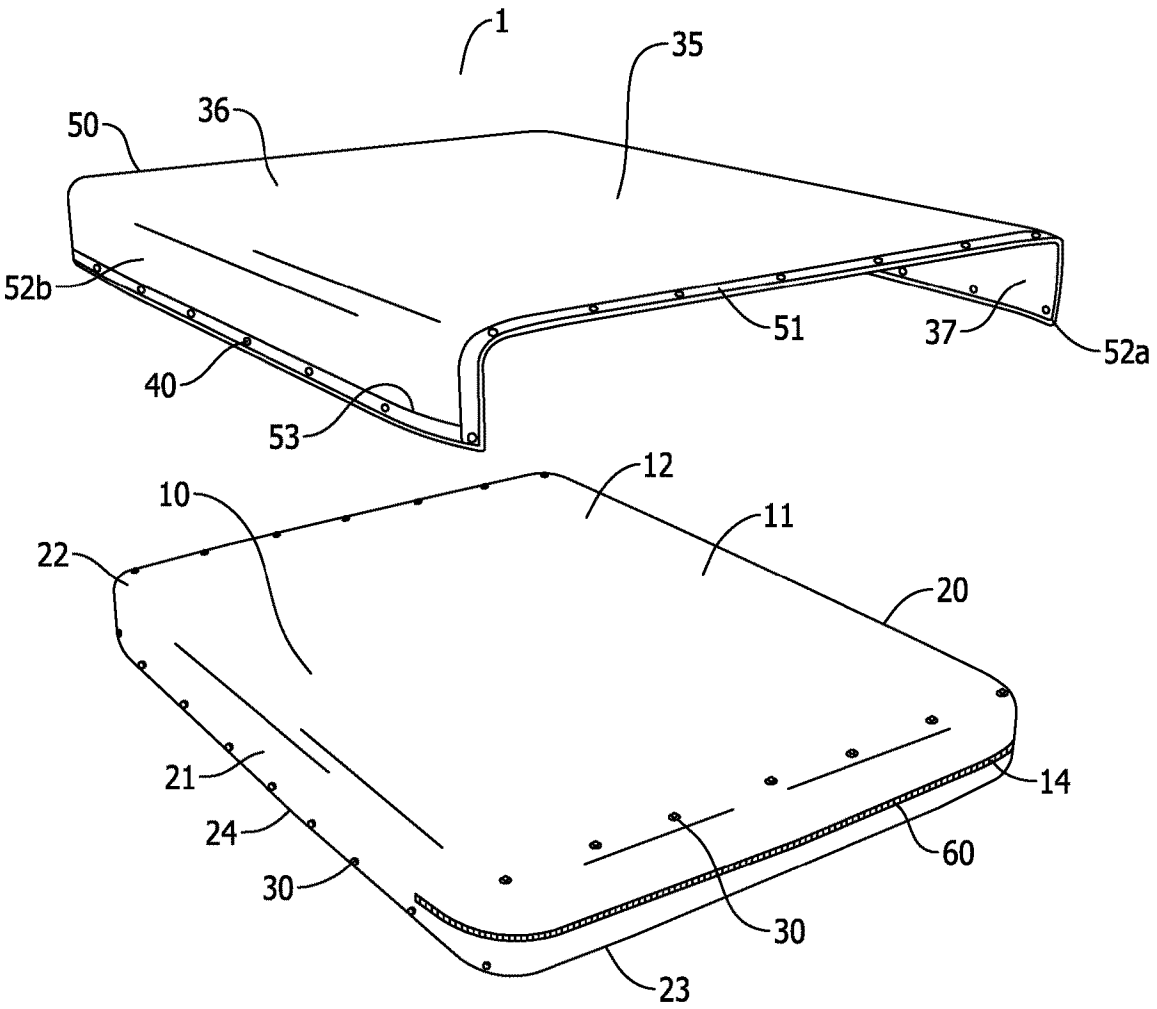
FIG. 8 is an exploded perspective view depicting a preferred embodiment of the present invention bedding system, using snap buttons, showing the mattress cover enveloping a mattress within its covering material and a first sheet separated from the mattress cover to show the cover fasteners on the mattress cover.

As seen in FIGS. 2-9, bedding system 1 comprises mattress cover 10. Mattress cover 10 has a covering material 11 with exterior surface 12, interior compartment 13 and sealable (re-closable) opening 14 allowing access to interior compartment 13. Re-closable opening 14 is sized and shaped to allow insertion of mattress 2 into interior compartment 13 of mattress cover 10. Mattress cover 10 is also sized and shaped to receive mattress 2 inside it such that when mattress 2 is so received by mattress cover 10, the covering material 11 snugly envelopes mattress 2 so that: a first side portion 20 of mattress cover 10 is adjacent to and follows the contour of first mattress side panel 7*a* of mattress 10; a second side portion 21 of mattress cover 10 is adjacent to and follows the contour of second mattress side panel 7*b* of mattress 2; a head portion 22 of mattress cover 10 is adjacent to head panel 5 of mattress 2; and a foot portion 23 of mattress cover 10 is adjacent to foot panel 6 of mattress 2. This is shown in FIGS. 3, 7 and 8. Mattress cover 10 includes a plurality of cover fasteners 31) disposed on the first side portion 20, second side portion 21, head portion 22 and foot portion 23.

Embodiment bedding system 1 includes first sheet 35. As best seen in FIGS. 7 and 8, first sheet 35 includes a first plurality of sheet fasteners 40, preferably located on underside 37 of first sheet 35. Each of sheet fasteners 40 complementarily engage one of the cover fasteners 30 on the first side portion 20, second side portion 21, head portion 22 of mattress cover 10 and foot portion 23. First sheet 35 further includes a head edge 50, a foot edge 51 and first and second lateral sheet panels 52*a,* 52*b.* When first sheet 35 is overlaid onto mattress cover 10 and each of sheet fasteners 40 complementarily engages one of cover fasteners 30, head edge 50 aligns with head panel 5 of mattress 2, foot edge 51 and aligns with foot panel 6 of mattress 2, first side sheet panel 52*a* overlays first side portion 20 of mattress cover 10 and aligns with the first mattress side panel 7*a* of mattress 2 and second side sheet panel 52*b* overlays second side portion 21 of mattress cover 10 and aligns with second side panel 7*b* of mattress 2.

The positioning of cover fasteners 30 preferably matches up with the array of the first plurality of sheet fasteners 40 for convenient attaching of first sheet 35 to cover 10 and aligning first sheet 35 or a cover 10. Cover fasteners 30 and first plurality of sheet fasteners 40 are preferably respectively positioned on mattress cover 10 as follows. Each side portion 20, 21 of mattress cover 10 includes a row of cover fasteners 30 located toward the bottom 24 of side portions 20, 21. As can be seen in the figures, each row of cover fasteners 30 runs along the bottom 24 of the first and second side portions 20, 21 of mattress cover 10 that overlay lateral side panels 7*a,* 7*b* of the mattress 2. (In FIG. 3, cover fasteners 30 are shown in the more particular form of swatch 38 having the hook portion of a hook and loop fastener.) These cover fasteners 30 releasably engage with a grouping of sheet fasteners 40 located near edge 53 of lateral sheet portions 52*a,* 52*b* when first sheet 35 is overlaid on mattress cover 10 with inserted mattress 2. (In FIG. 4, sheet fasteners 40 are shown in the more particular form of swatch 39 having the loop portion of a hook and loop fastener.)

A second group of cover fasteners 30 are disposed on or adjacent foot portion 23 of mattress cover 10. This second group of cover fasteners 30 releasably engage with a counterpart second grouping of first sheet fasteners 40 located at foot edge 51 of first sheet 35. This grouping of cover fasteners 30 would run adjacent or along edge 26 of mattress cover 10 that defines the corner where foot panel 6 of mattress 2 meets top panel 3 of mattress 2. In a more preferred arrangement, cover fasteners 30 on mattress cover 10 would be slightly below edge 26 on foot portion 23 of mattress cover 10.

Similarly, mattress cover 10 includes a third group of cover fasteners 30 disposed on or adjacent head portion 22 of mattress cover 10. These cover fasteners 30 releasably engage with a counterpart third grouping of sheet fasteners 40 located at head edge 50 of first sheet 35. As seen in the figures, this grouping of fasteners preferably runs adjacent to or along the edge 25 of mattress cover 10 defining the corner where head panel 5 of mattress 2 meets top panel 3 of mattress 2. In a more preferred arrangement, these cover fasteners 30 on mattress cover 10 would be slightly below edge 25 on the head portion 22 of mattress cover 10.

Hence, in the preferred embodiment, groupings of cover fasteners are located at bottom 24 of first and second side portions 20, 21 of cover 10 so that first sheet 35 will cover all areas of mattress cover 10 on its sides. However, to simplify installation of first sheet 35, the groupings of cover fasteners 30 that are located at head portion 22 and foot portion 23 are preferably located at edges 25, 26 of cover 10. This is because many beds have large head and foot boards which can make it difficult to reach behind.

In a first preferred embodiment, cover fasteners 30 and first plurality of sheet fasteners 40 comprise complementary hook and loop (Velcro®) fasteners. In this embodiment, it is preferable that cover fastener 30 comprise a swatch 38 including the hook portion of the known hook and loop fastening system sewn onto mattress cover 10. Sheet fastener 40 would preferably include swatch 39 containing the loop portion of the hook and loop fastening system.

Figure 9:
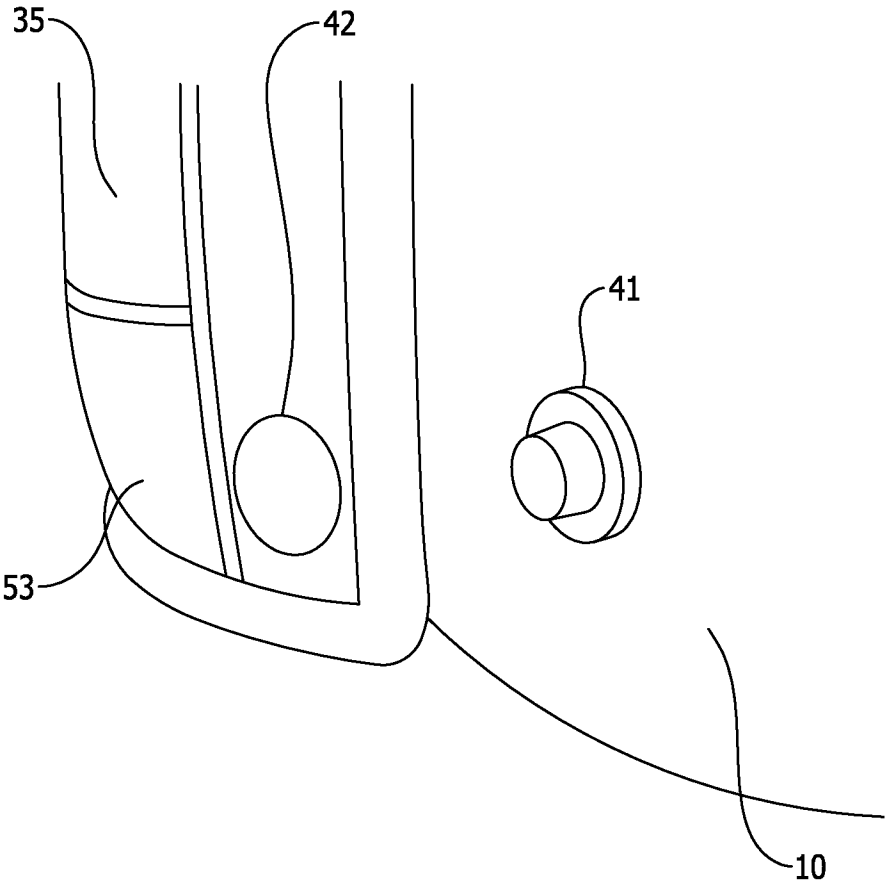
FIG. 9 is a detailed view illustrating exemplary embodiment cover and sheet snap button fasteners having utility in the present invention system.

In an alternate embodiment shown in FIGS. 7-9, cover fasteners 30 and sheet fasteners 40 comprise engaging snaps buttons (fasteners) consisting of a male button 41 that is received by a female button 42. In one embodiment using snap buttons, the male button has a projection with an annular groove. When the projection of the male button is pressed into the female button, resilient structure on the female button expands around the tip of the projection and when the projection is fully inserted, the resilient structure engages the annular groove of the male button. Because the structure holding the projection is resilient, the two buttons can be pulled apart by a separating force manually applied to the engaged buttons in a direction parallel to the male projection. The buttons can be of any known material including metal and plastic. In this embodiment, it is preferable that cover fastener 30 comprise male button 41 and sheet fastener 40 comprise female button 42. In another embodiment, the complementary fasteners 30 could comprise buttons on one of cover 10 or first sheet 35 and buttonholes on the other. In this embodiment, it is preferable that the cover fastener 30 be a button and sheet fastener 40 be the buttonhole.

Figure 10:
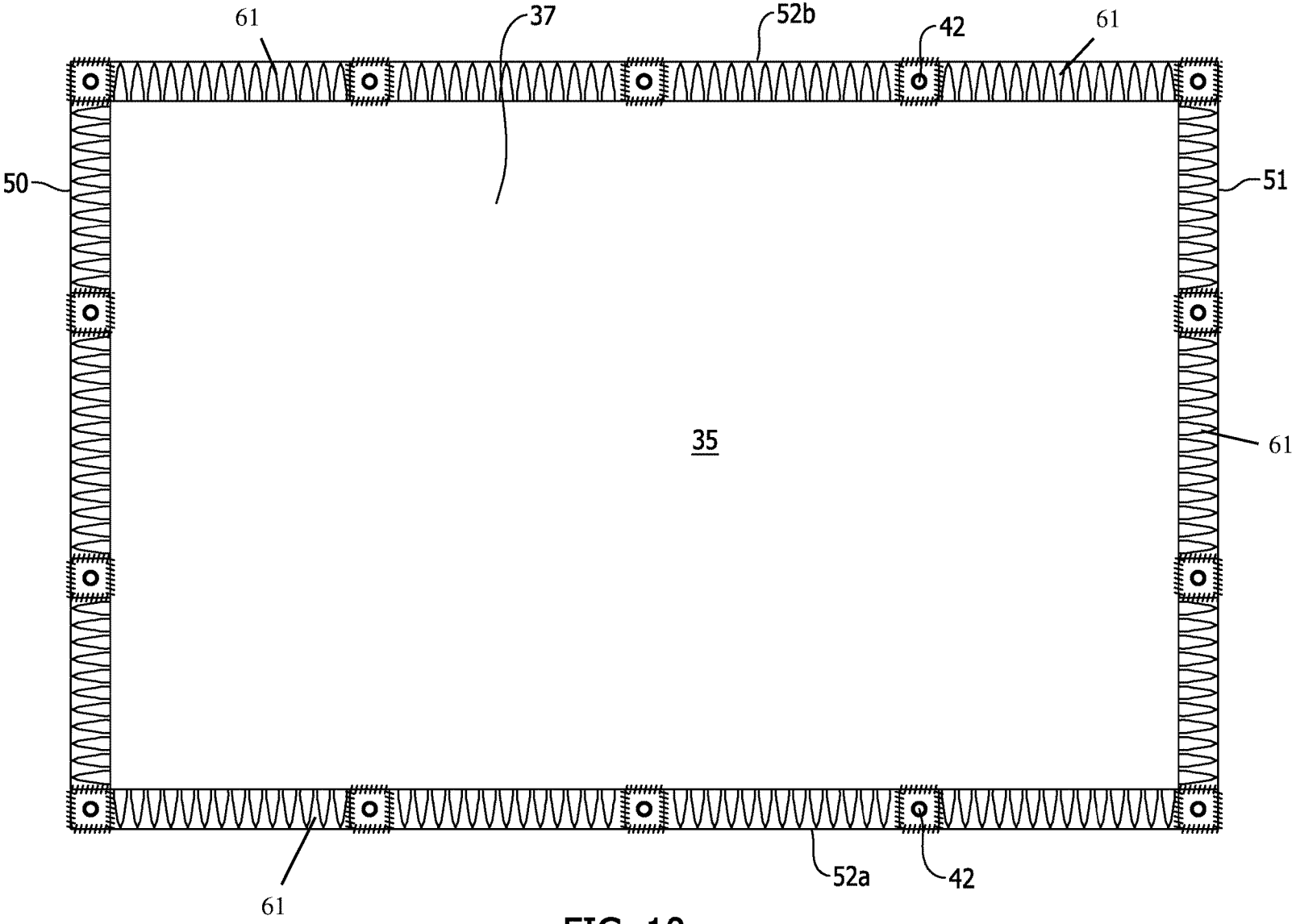
FIG. 10 is a plan view of the underside of a first sheet of an embodiment system using snap button fasteners to fasten the first sheet to the mattress cover. The embodiment first sheet shown includes elastic sections between the snap button fasteners to account for shrinkage in the sheet from laundering the sheet over time.

Mattress cover 10 preferably includes a closure mechanism 60, which in the preferred depicted embodiment is a zipper located at the foot portion 23 of mattress cover 10. Alternative closure mechanisms such as snap buttons and buttons and button holes also are acceptable closure mechanisms. Closure mechanism 60 serves to re-close opening 14 and tighten mattress cover 10 around contained mattress 2 such that covering material 11 of mattress cover 10 neatly overlays and follows the shape of mattress 2 and the contours of its panels 3, 4, 5, 6 and 7*a*, 7*b*. Once mattress 2 is inserted inside cover 10, then installing first sheet 35 onto cover 10 is as simple as placing first sheet 35 on top of cover 10 and engaging each of the plurality of sheet fasteners 40 to a cover fastener 30. When button/button hole or snap button fasteners 41, 42 are employed, it is advantageous to include elastic sections 61 in first sheet 35 to account for shrinkage of the sheet from laundering. This is shown in FIG. 10. These elastic sections 61 can also be used with Velcro® fasteners 38, 39. Thus, system 1 may include elastic sections 61 at the edges of sheet 35 where fasteners 40 are placed.

In a further enhancement of the present invention system, the system includes a second sheet 70 that has a top side 71, an underside 72, a head edge 73, a foot edge 74 and side edges 75. An exemplary embodiment second sheet 70 is shown in FIG. 6. Upper side 36 of first sheet 35 includes a second plurality of fasteners 80 that releasably engage with a third plurality of fasteners 81 on the underside 71 of first sheet 70. As shown in the figures, preferably fasteners 80 are located at foot edge 51 of first sheet 35. Fasteners 81 are similarly located at foot edge 74 of second sheet 70. Fasteners 80 and 81 preferably comprise, but need not limitedly be, the hook and loop, snap button and button/buttonhole fasteners described above. When fasteners 80 and 81 are chosen from this selection of fasteners it is preferred that the upper side 36 of first sheet 35 have the loop portion of the hook and loop fastener or the female snap button. To install second sheet on to first sheet, one need only overlay second sheet 70 on first sheet 35, align fasteners 80 and 81 and then engage fasteners 80 to 81. Once that is done, second sheet 70 may be pulled tightly toward head edge 50 of first sheet 35 and laid down onto first sheet 35.

The system makes it quick and easy to replace a first sheet or second sheet for any reason. With the inventive system, the user may not have to maneuver around a head or foot board to install either the first sheet or the second sheet. This system also reduces the need to have auxiliary mechanisms, such as straps to keep the sheets from slipping off.

The present invention sheet system eliminates the fitted sheet of the prior art and allows for the easy, secure and properly aligned placement of a first sheet on to a mattress. By virtue thereof, housekeeping personnel and anyone else changing bed linens will no longer need to lift a mattress in order to install the first sheet. In addition, whereas fitted sheets with elastic corners are known to come off the mattress corners after application due to motion of sleep occupants on the bed. However, the inventive Sheet system reduces that problem because the sheets are secured to the mattress cover and the described fasteners are not prone to release due to the sheer forces applied to the sheet from occupant motion.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

What is claimed is:

1. A bedding system for a mattress, the mattress having a top panel, a bottom panel, a head panel, a foot panel, a first mattress side panel extending from the head panel to the foot panel and a second mattress side panel extending from the head panel to the foot panel, each of the panels of the mattress having a surface contour, the bedding system comprising:

a mattress cover, the mattress cover having a covering material with an exterior surface, an interior compartment defined by the covering material and an opening allowing access to the interior compartment;

the opening being sized and shaped to allow insertion of the mattress into the interior compartment of the mattress cover;

the mattress cover being sized and shaped to receive the mattress inside it such that when the mattress is inserted into the interior compartment of the mattress cover, the covering material envelopes the mattress so that a first side portion of the mattress cover is adjacent to and follows the surface contour of the first mattress side panel; a second side portion of the mattress cover is adjacent to and follows the surface contour of the second mattress side panel; a head portion of the mattress cover is adjacent to the head panel of the mattress; and a foot portion of the mattress cover is adjacent to the foot panel of the mattress;

the mattress cover including a plurality of cover fasteners disposed along the first side portion; the second side portion; the head portion; and the foot portion;

a first sheet, the first sheet including a first plurality of sheet fasteners, each of the sheet fasteners complementarily engaging one of the plurality of cover fasteners;

the first sheet further including a head edge, a foot edge, a first side sheet panel and a second side sheet panel; and when the mattress is inserted into the interior compartment of the mattress cover, the first sheet is overlaid onto the mattress cover and each of the first plurality of sheet fasteners complementarily engages one of the plurality of cover fasteners:

the head edge of the first sheet is adjacent to the head portion of the mattress cover and aligns with the head panel of the mattress;

the foot edge of the first sheet is adjacent to the foot portion of the mattress cover and aligns with the foot panel of the mattress;

the first side sheet panel overlays the first side portion of the mattress cover and aligns with the first mattress side panel; and the second side sheet panel overlays the second side portion of the mattress cover and aligns with the second mattress side panel;

the first sheet having an upper side and including a second plurality of sheet fasteners affixed to the upper side of the first sheet;

a second sheet having head edge, a foot edge and an underside, the second sheet further including a third plurality of sheet fasteners affixed to the underside of the second sheet;

each of the second plurality of sheet fasteners being releasably engageable with one of the third plurality of sheet fasteners; and when the second sheet is overload on top of the first sheet and each of second plurality of sheet fasteners on the upper side of the first sheet is connected to one of the third plurality of sheet fasteners on the underside of the second sheet, the foot edge of the second sheet is adjacent to the foot edge of the first sheet.

2. The bedding system of claim 1 wherein the opening is re-sealable.

* * * * *